US009462876B2

(12) United States Patent
Drori

(10) Patent No.: US 9,462,876 B2
(45) Date of Patent: Oct. 11, 2016

(54) SHOPPING BAGS CARRIER AND CARRYING METHOD THEREFOR

(71) Applicant: Noam Drori, Beer-Sheva (IL)

(72) Inventor: Noam Drori, Beer-Sheva (IL)

( * ) Notice: Subject to any disclaimer, the term of this patent is extended or adjusted under 35 U.S.C. 154(b) by 249 days.

(21) Appl. No.: 14/281,423

(22) Filed: May 19, 2014

(65) Prior Publication Data

US 2015/0327656 A1 Nov. 19, 2015

(51) Int. Cl.
*A45F 3/08* (2006.01)
*A45F 5/10* (2006.01)

(52) U.S. Cl.
CPC ..... *A45F 3/08* (2013.01); *A45F 5/102* (2013.01); *A45F 5/1026* (2013.01); *Y10S 224/925* (2013.01)

(58) Field of Classification Search
CPC ..... A45F 5/1026; A45F 5/102; A45F 3/10; A45F 3/04; A45F 3/042; A45F 2003/045; A45F 3/047; A45F 3/06; A45F 3/08; A45F 3/14; A45F 2003/003; Y10S 224/925
USPC ..... 224/925, 682–684, 627–628, 259, 224/261–263, 268, 907, 633–637, 642–644, 224/650
See application file for complete search history.

(56) References Cited

U.S. PATENT DOCUMENTS 1,296,619 A * 3/1919 Bulat ..... A47D 13/025 224/160
4,469,259 A * 9/1984 Krich ..... A47D 13/025 224/159
5,131,576 A * 7/1992 Turnipseed ..... A45F 3/08 224/262
5,363,953 A * 11/1994 Carter ..... A45C 11/16 206/495
2002/0092882 A1* 7/2002 Jones ..... A45C 7/0059 224/645
2009/0242601 A1* 10/2009 Inman ..... A45C 9/00 224/602
2013/0062375 A1* 3/2013 Finch ..... A45F 3/14 224/257
2013/0327662 A1* 12/2013 Loban ..... G10G 7/005 206/314

FOREIGN PATENT DOCUMENTS

CN 202722818 U * 2/2013
FR 2815595 A1 * 4/2002 ..... A45C 13/002
JP 2012224426 A * 11/2012
WO WO 2007102049 A1 * 9/2007 ..... A45F 3/14

* cited by examiner

*Primary Examiner* — Justin Larson
*Assistant Examiner* — Scott McNurlen
(74) *Attorney, Agent, or Firm* — Daniel J. Swirsky; AlphaPatent Associates Ltd.

(57) ABSTRACT

In one aspect, the present invention is directed to a shopping bags carrier (10), comprising: at least one board (12), for being rested on a back of a user; at least one strap (22) attached to the at least one board (12), for hanging the at least one board (12) on a shoulder(s) of the user; and at least one hook (26) attached to the at least one board (12), for hanging shopping bags (34) thereon, thereby facilitating carrying goods within the hanged shopping bags (34), by the user.

8 Claims, 4 Drawing Sheets

SHOPPING BAGS CARRIER AND CARRYING METHOD THEREFOR

FIELD OF THE INVENTION

The present invention relates to the field of shopping. More particularly, the invention relates to a method and apparatus for carrying shopping bags containing the goods.

BACKGROUND OF THE INVENTION

As a matter of habit, shopping bags, commonly disposable, are given for free by shops. After paying, the shopper fills these bags with the purchased goods, leaves the store, and carries the filled shopping bags hanged on the hands, to home or to a vehicle.

Such carrying on the hands can be quite a burden. Removing shopping bags, from a shopping cart provided by the shop, to a wheel-driven trolley of the customers maybe helpful.

However, the volume of a trolley is quite large, and thus transporting it to the shopping site is a nuisance. Also, a trolley cannot be transported along stairs or along non-smooth surfaces.

A trolley is further disadvantaged of requiring closing/tying each shopping bag, to avoid loss of the goods therefrom.

The methods described above have not yet provided satisfactory solutions to the problem of inconvenient carrying of shopping bags from shopping sites.

It is an object of the present invention to provide a method and apparatus for carrying shopping bags from shopping sites.

It is an object of the present invention to provide a solution to the above-mentioned and other problems of the prior art.

Other objects and advantages of the invention will become apparent as the description proceeds.

SUMMARY OF THE INVENTION

In one aspect, the present invention is directed to a shopping bags carrier (10), comprising:

at least one board (12), for being rested on a back of a user;

at least one strap (22) attached to the at least one board (12), for hanging the at least one board (12) on a shoulder(s) of the user; and at least one hook (26) attached to the at least one board (12), for hanging shopping bags (34) thereon, thereby facilitating carrying goods within the hanged shopping bags (34), by the user.

The shopping bags carrier (10) may further comprise:

a stretchable sheet (16), for forming a compartment (12, 16) between the stretchable sheet (16) and the at least one board (12), the stretchable sheet (16) for stretching thereof on shopping bags (34), for securing goods contained therein.

The at least one strap (22) may comprise two straps (22), for winding each strap (22) on one shoulder.

The shopping bags carrier (10) may further comprise:

a handle (24) attached to a top of the at least one board (12), for holding thereof.

The shopping bags carrier (10) may further comprise:

a foldable stand (30) pivotally connected to the at least one board (12), for leaning the at least one board (12) in a partially-erected position, thereby enabling hanging the shopping bags (34) in the partially-erected position.

The foldable stand (30) may comprise a pivot (32) comprising a constraint, for limiting the opening of the stand (30), thereby securing the leaning of the at least one board (12) in the partially-erected position.

The stretchable sheet (16) may further comprise a frame (14) for being deployed thereupon, the frame (14) pivotally connected to the at least one board (12).

The at least one board (12) may comprise a quilting (50), for quilting the at least one board (12) or a portion thereof, thereby providing comfort in carrying the shopping bags carrier (10) on the user's back.

The at least one board (12) may orthopedically be shaped for fitting the shape of the back, thereby providing comfort in carrying it on the user's back.

The at least one board (12) preferably is rigid or partially-rigid.

The attachment of the at least one hook (26) to the at least one board (12) may comprise disposition of the at least one hook (26) above the waist of the user wearing the shopping bags carrier (10), thereby the legs of the users do not encounter the shopping bags (34).

The reference numbers have been used to point out elements in the embodiments described and illustrated herein, in order to facilitate the understanding of the invention. They are meant to be merely illustrative, and not limiting. Also, the foregoing embodiments of the invention have been described and illustrated in conjunction with systems and methods thereof, which are meant to be merely illustrative, and not limiting.

BRIEF DESCRIPTION OF THE DRAWINGS

Embodiments and features of the present invention are described herein in conjunction with the following drawings.

It should be understood that the drawings are not necessarily drawn to scale.

DETAILED DESCRIPTION OF PREFERRED EMBODIMENTS

The present invention will be understood from the following detailed description of preferred embodiments, which are meant to be descriptive and not limiting. For the sake of brevity, some well-known features, methods, systems, procedures, components, circuits, and so on, are not described in detail.

Figure 1:
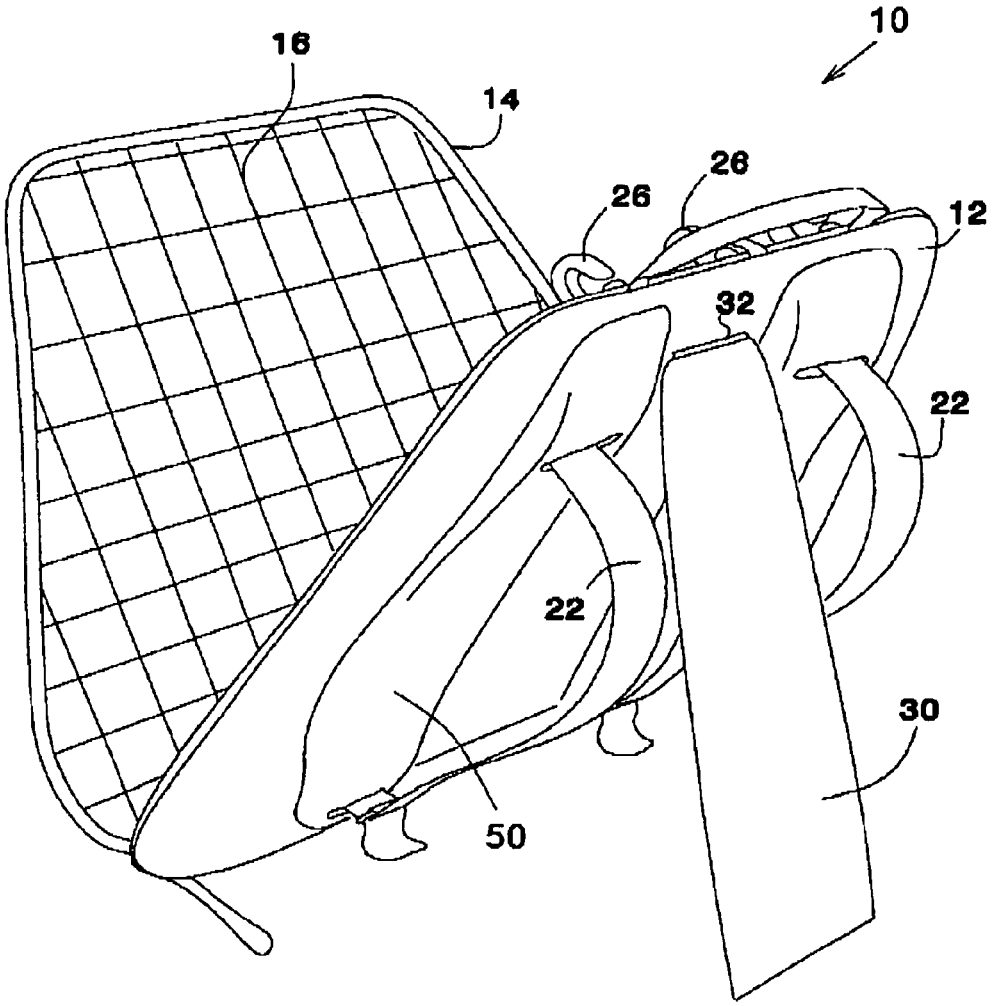
FIG. 1 is a sectional view of a shopping bags carrier, according to one embodiment of the present invention.

FIG. 1 is a sectional view of a shopping bags carrier, according to one embodiment of the present invention.

A shopping bags carrier 10 includes at least one board 12, for being carried on a back of a person. Board 12 preferably is rigid or partially rigid, for resting the surface thereof on the back of the user, thus distributing the weight of the goods upon the entire area of the back.

The resting of the goods on the back provides disposing the weight of the goods on the center of the body, and not at one side thereof.

Straps 22 are connected to board 12 at the front side thereof. Shopping bags carrier 10 includes a plurality of hooks 26 at the rear side of board 12, for hanging shopping bags 34 thereon.

Shopping bags carrier may further include a stretchable sheet 16, for covering hooks 26 and shopping bags 34, forming a compartment including board 12 and stretchable sheet 16. Stretchable sheet secures shopping bags 34 to board 12 to avoid swinging of shopping bags 34 on hooks 26 while walking or even while running.

According to one embodiment, stretchable sheet 16 may constitute a stretchable net, through which shopping bags 34 and board 12 may be viewed, thus the sectional view of FIG. 1 may be an actual view.

After hanging shopping bags 34 on hooks 26, and after stretching stretchable sheet 16 thereupon, the user can conveniently carry shopping bags carrier 10 containing shopping bags 34 on the back.

This carrying is preferably accompanied by winding straps 22 on the shoulders to hang thereon, providing that board 12 rests on the back of the user. Shopping bags carrier 10 ensures that shopping bags 34 are secured thereto, and thus to the user's back. This form of carrying allows carrying shopping bags 34 not swinging even while running.

Figure 2:
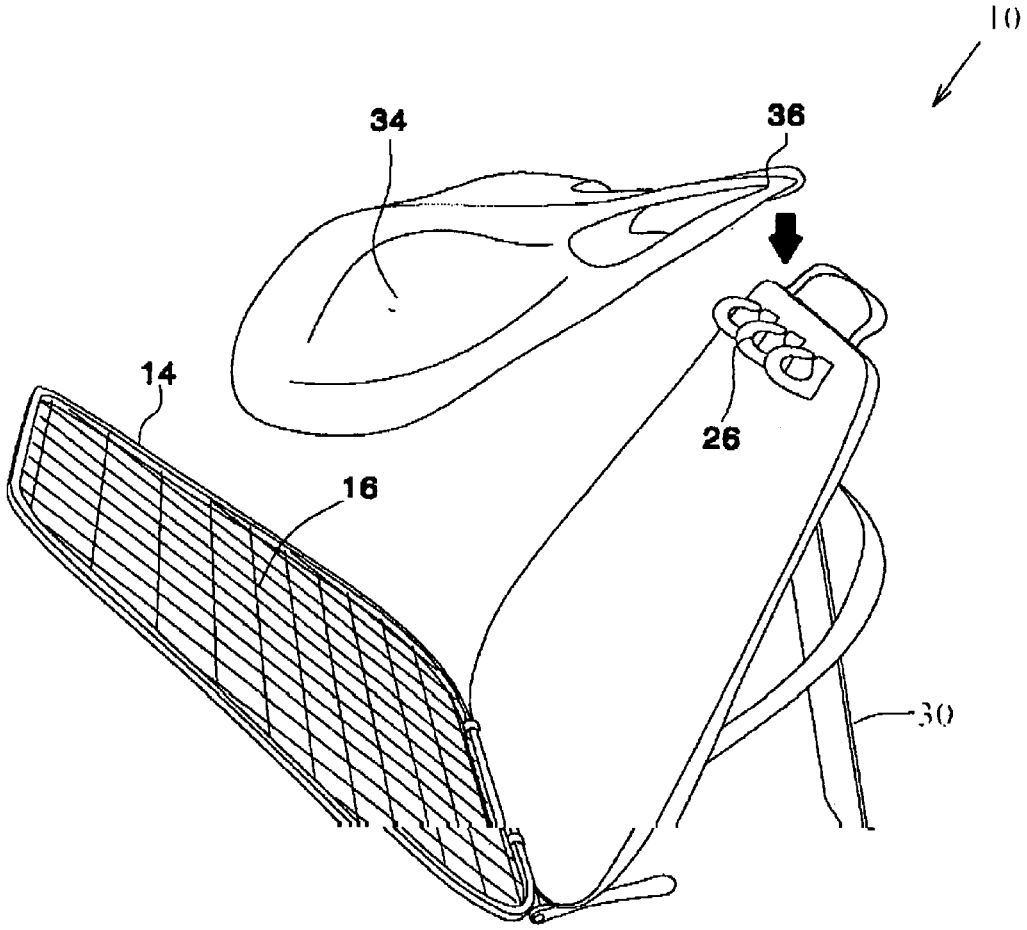
FIG. 2 depicts the shopping bags carrier of FIG. 1 at the open state at the first and second steps.

FIG. 2 depicts the shopping bags carrier of FIG. 1 at the open state at the first and second steps.

Board 12 preferably is quilted by quilting 50 especially at the zone of straps 22, and may be orthopedically shaped according to the shape of the back, for providing comfort in carrying it on the user's back.

Board 12 preferably includes a foldable stand 30 at the front side thereof. Foldable stand 30 is pivotally connected to board 12 via a pivot 32, having a physical constraint, which limits the opening of foldable stand 30. The opening of stand 30 preferably is limited for leaning board 12 in a partially-erected position. The partially-erected position preferably tilts shopping bags carrier 10 to be between about 40 to 80 degrees.

At the first step, foldable stand 30 is opened, for leaning board 12 on a table.

At the second step, stretchable sheet 16, which is deployed about a frame 14, is opened.

Figure 3:
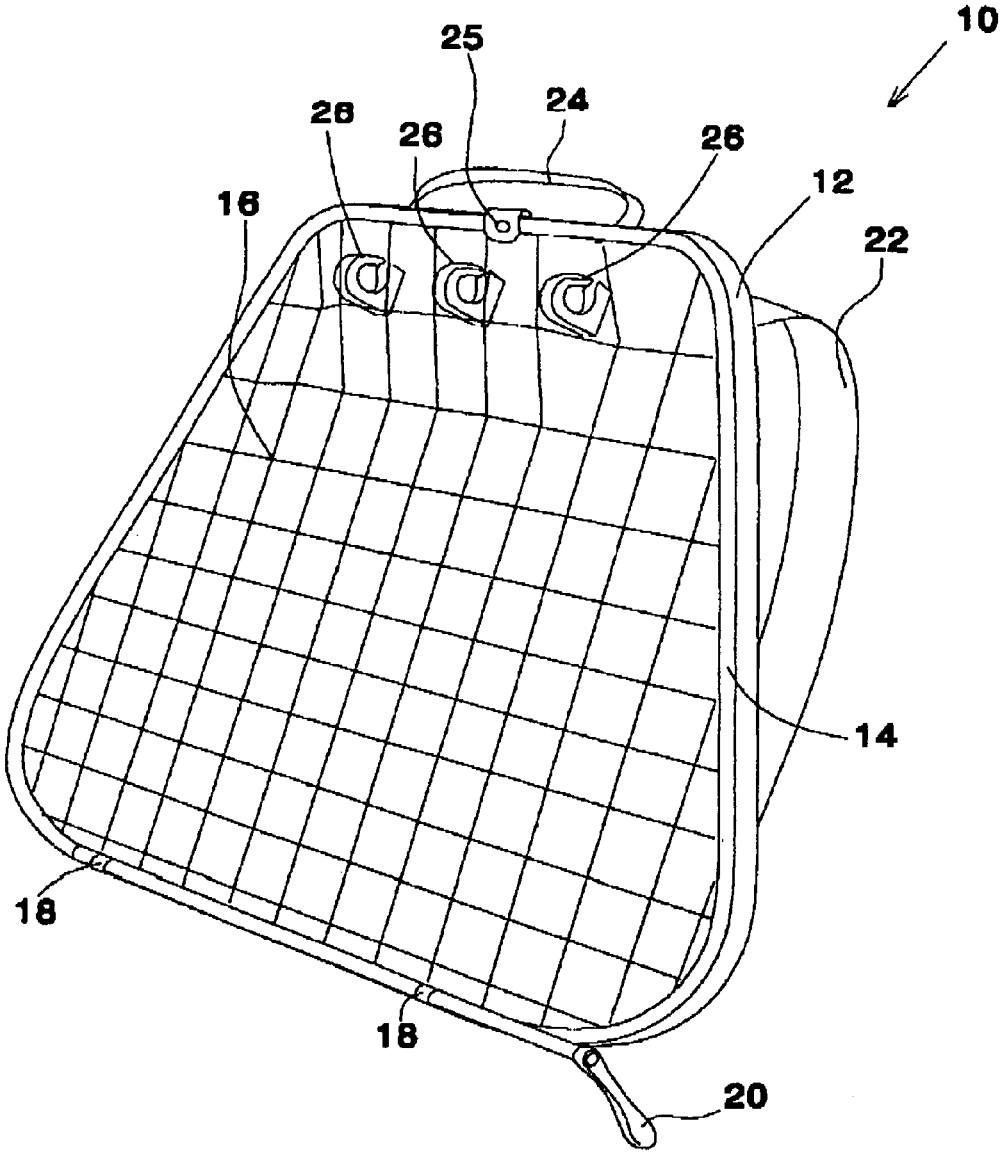
FIG. 3 depicts the shopping bags carrier of FIG. 1 at the open state at the next steps.

FIG. 3 depicts the shopping bags carrier of FIG. 1 at the open state at the next steps.

Hooks 26 are rigidly connected to board 12.

At the third step, the user hangs handles 36 of shopping bags 34 on hooks 26. At the fourth step, the user covers shopping bags 34 with stretchable sheet 16 to the state depicted in FIG. 1. At the fifth step, the user folds stand 30. At the sixth step, the user carries shopping bags carrier 10 by straps 22.

Figure 4:
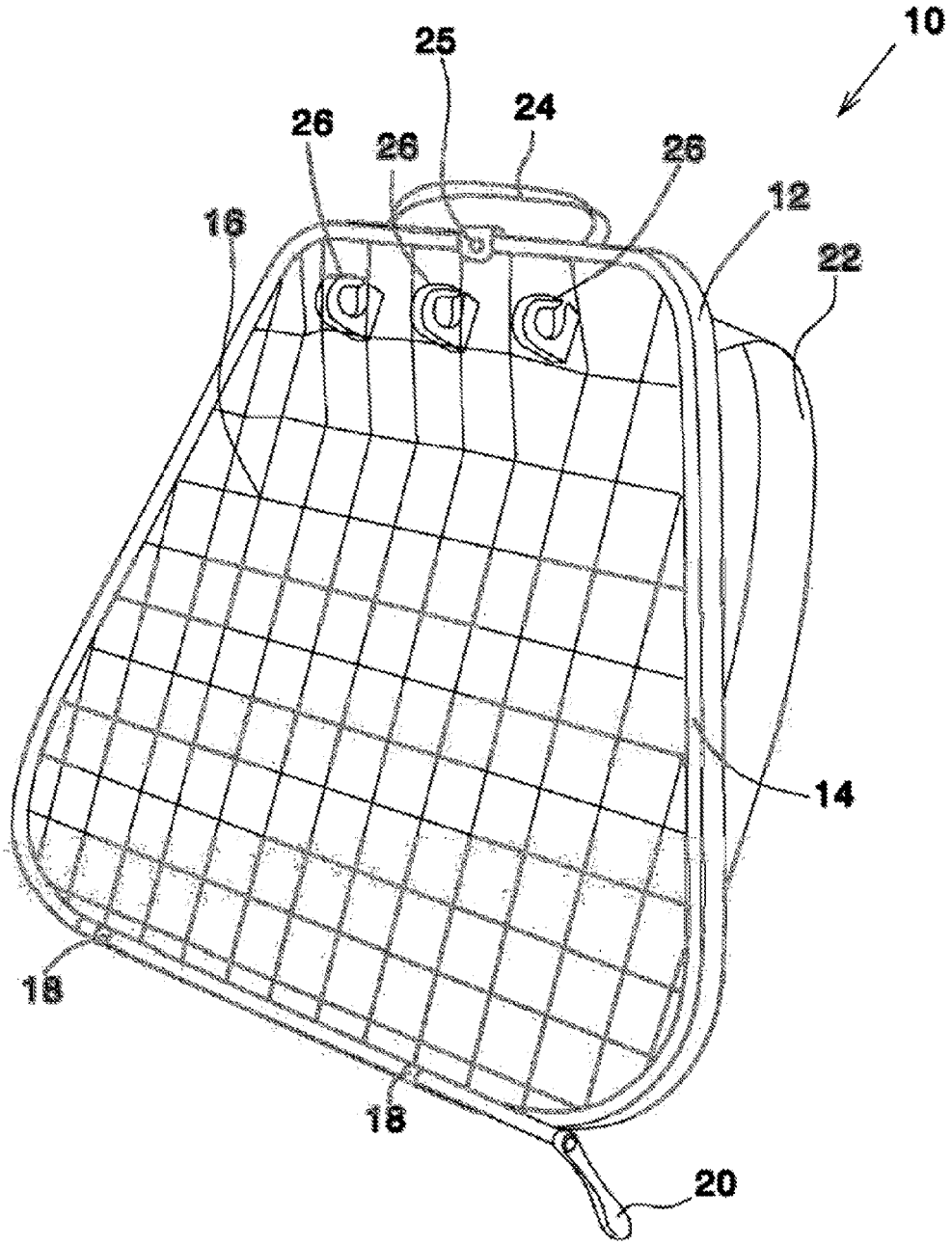
FIG. 4 depicts the shopping bags carrier of FIG. 1 at the closed state while empty.

FIG. 4 depicts the shopping bags carrier of FIG. 1 at the closed state while empty.

Since sheet 16 is stretchable, and thus does not occupy space for covering board 12 only, in contrast to a common carrying suitcase, the thickness of shopping bags carrier 10 when empty is minimal. Thus, there is no inconvenience in bringing shopping bags carrier 10 to the shopping site.

Shopping bags carrier 10 may include a handle 24 for carrying thereby, instead of by straps 22. Frame 14 deploying stretchable sheet 16, preferably is pivotally connected to board 12 via a pivot 18. Frame 14 is preferably secured to board 12 while carrying the goods by a lock 25. A handle 20 may assist in rotating frame 14 in relation to board 12.

Shopping bags carrier 10, in addition to the added convenience of carrying, is also a safer and healthier means of carrying. The attachment of hooks 26 to board 12 are preferably designed to disposition of hooks 26 above the waist of the user wearing shopping bags carrier 10, thus the legs of the users do not encounter shopping bags 34.

In the figures and/or description herein, the following reference numerals have been mentioned:

numeral 10 denotes a shopping bags carrier, according to one embodiment of the present invention;

numeral 12 denotes a board for being rested on a back of a user;

numeral 14 denotes a frame;

numeral 16 denotes a stretchable sheet;

numeral 18 denotes a pivot;

numeral 20 denotes a handle for rotating the frame in relation to the board;

numeral 22 denotes a strap, for carrying the board on the shoulder;

numeral 24 denotes a handle for carrying the board by hand;

numeral 25 denotes a lock, for securing the frame holding the stretchable sheet to the board;

numeral 26 denotes a hook for hanging a shopping bag thereon;

numeral 30 denotes a foldable stand;

numeral 32 denotes a pivot;

numeral 34 denotes a shopping bag;

numeral 36 denotes a handle of a shopping bag; and numeral 50 denotes quilting.

The foregoing description and illustrations of the embodiments of the invention has been presented for the purposes of illustration. It is not intended to be exhaustive or to limit the invention to the above description in any form.

Any term that has been defined above and used in the claims, should to be interpreted according to this definition.

The reference numbers in the claims are not a part of the claims, but rather used for facilitating the reading thereof. These reference numbers should not be interpreted as limiting the claims in any form.

What is claimed is:

1. A backpack (10), comprising:

at least one board (12), for being rested on a back of a user;

a foldable stand (30) pivotally connected to the at least one board (12), for leaning said at least one board (12) in a partially-erected position; thereby enabling hanging shopping bags (34) in said partially-erected position;

at least one strap (22) attached to said at least one board (12), for hanging said at least one board (12) onto a shoulder(s) of said user;

at least one hook (26) attached to said at least one board (12), for hanging said shopping bags (34) thereon;

a stretchable sheet (16) for securing said shopping bags (34) hung on said at least one hook, thereby avoiding swinging of said shopping bags (34) while said backpack (10) is carried by said user; and a frame (14) for deploying said stretchable sheet (16) thereupon, said frame (14) being pivotally connected to said at least one board (12), and being shaped for deploying said stretchable sheet (16) over a significant region of said at least one board (12) upon attaching said frame (14) to said at least one board (12), thereby said attaching, being obtained by rotating said frame (14) about said pivotal connection towards said at least one board (12), forms an extendable and openable compartment (12, 16) between said stretchable sheet (16) and said at least one board (12), for entirely containing said shopping bags (34), thereby facilitating carrying goods within said hanged shopping bags (34), by said user.

2. The backpack (10) according to claim 1, wherein said at least one strap (22) comprises two straps (22), for winding each strap (22) on one shoulder.

3. The backpack (10) according to claim 1, further comprising; a handle (24) attached to a top of said at least one board (12), for holding thereof.

4. The backpack (10) according to claim 1, wherein said foldable stand (30) comprises a pivot (32) comprising a constraint, for limiting the opening of said stand (30), thereby securing said leaning of said at least one board (12) in said partially-erected position.

5. The backpack (10) according to claim 1, wherein said at least one board (12) comprises a quitting (50), for quilting said at least one board (12) or a portion thereof, thereby providing comfort in carrying said backpack (10) on the user's back.

6. The backpack (10) according to claim 1, wherein said at least one board (12) is orthopedically shaped for fitting the shape of the user's back, thereby providing comfort in carrying the backpack on the user's back.

7. The backpack (10) according to claim 1, wherein said at least one board (12) is rigid or partially rigid.

8. The backpack (10) according to claim 1, wherein said attachment of said at least one hook (26) to said at least one board (12) comprises disposition of said at least one hook (26) above the waist of the user wearing said backpack (10), thereby legs of said user do not encounter the shopping bags (34).

* * * * *